US011987965B2

(12) United States Patent
Wölfler et al.

(10) Patent No.: US 11,987,965 B2
(45) Date of Patent: May 21, 2024

(54) SINK WITH MOVABLE INSERT PLATE AND SEALING SLEEVE FOR A LIFTING UNIT

(71) Applicant: BSH Hausgeräte GmbH, Munich (DE)

(72) Inventors: Andreas Wölfler, Saalfelden (AT); Benjamin Reu, Prien am Chiemsee (DE); Jörg Sukale, Altenmarkt a.d. Alz (DE)

(73) Assignee: BSH Hausgeräte GmbH, Munich (DE)

( * ) Notice: Subject to any disclaimer, the term of this patent is extended or adjusted under 35 U.S.C. 154(b) by 107 days.

(21) Appl. No.: 17/779,582

(22) PCT Filed: Nov. 11, 2020

(86) PCT No.: PCT/EP2020/081741

§ 371 (c)(1),
(2) Date: May 25, 2022

(87) PCT Pub. No.: WO2021/104874

PCT Pub. Date: Jun. 3, 2021

(65) Prior Publication Data

US 2023/0003010 A1 Jan. 5, 2023

(30) Foreign Application Priority Data

Nov. 29, 2019 (DE) ..... 102019218644.0

(51) Int. Cl.
*E03C 1/186* (2019.01)

(52) U.S. Cl.
CPC ..... *E03C 1/186* (2013.01)

(58) Field of Classification Search
CPC ..... E03C 1/181; E03C 1/186; A47J 47/20; A47L 17/02; A47L 19/02
See application file for complete search history.

(56) References Cited

U.S. PATENT DOCUMENTS 3,882,553 A 5/1975 Poiencot
3,913,928 A * 10/1975 Yamaguchi ..... F16L 25/10 277/615
2005/0067747 A1 3/2005 Erickson

FOREIGN PATENT DOCUMENTS

CN 103603415 A * 2/2014
CN 105645301 A 6/2016
CN 108316413 A * 7/2018
CN 108316413 A 7/2018
CN 207812582 U * 9/2018
CN 109695274 A 4/2019
CN 109695275 A * 4/2019
(Continued)

OTHER PUBLICATIONS

National Search Report DE 102019218644 dated Nov. 3, 2020.
International Search Report PCT/EP2020/081741 dated Feb. 2, 2021.

*Primary Examiner* — Erin Deery
(74) *Attorney, Agent, or Firm* — Michael E. Tschupp; Brandon G. Braun; Andre Pallapies

(57) ABSTRACT

A sink includes a basin including a base wall and lateral walls adjoining the base wall. The basin includes a receiving area which is delimited by the base wall and the lateral walls. An insert plate separate from the basin is inserted into the receiving area and moved by a lifting device relative to the basin. The lifting device includes a lifting unit which is surrounded by an elastic sealing sleeve.

20 Claims, 4 Drawing Sheets

(56) References Cited

FOREIGN PATENT DOCUMENTS

| | | | | | |
|---|---|---|---|---|---|
| CN | 111379291 | A * | 7/2020 | ..... | E03C 1/0402 |
| DE | 3621151 | A1 | 1/1988 | | |
| WO | WO-2016051238 | A1 * | 4/2016 | ..... | E03C 1/18 |

* cited by examiner

SINK WITH MOVABLE INSERT PLATE AND SEALING SLEEVE FOR A LIFTING UNIT

CROSS-REFERENCES TO RELATED APPLICATIONS

This application is the U.S. National Stage of International Application No. PCT/EP2020/081741, filed Nov. 11, 2020, which designated the United States and has been published as International Publication No. WO 2021/104874 A1 and which claims the priority of German Patent Application, Serial No. 10 2019 218 644.0, filed Nov. 29, 2019, pursuant to 35 U.S.C. 119(a)-(d).

The contents of International Application No. PCT/EP2020/081741 and German Patent Application, Serial No. 10 2019 218 644.0 are incorporated herein by reference in their entireties as if fully set forth herein.

BACKGROUND OF THE INVENTION

One aspect of the invention relates to a sink with a basin. The basin has a base wall and lateral walls adjoining the base wall. The basin has a receiving area delimited by the walls. Moreover, the sink has an insert plate which is separate from the basin and which is inserted into the receiving area.

Such sinks are known. Thus a sink which has a basin is disclosed, for example, in US 2005/0067747 A1. A base which is configured in one piece with the basin bottom and which extends upwardly is configured on the basin bottom. A plate may be attached to this base. As a result, a cutting board is formed on which objects, such as food, may be chopped. Such an embodiment is disadvantageous in that the integrated base is always present and thus a basic embodiment of the basin is complex in terms of shape and is configured such that the receiving area is restricted over the periphery. Moreover, it is always the case that the plate which is able to be positioned on the base is arranged only at one height level. The plate is only able to be positioned or removed by a user.

A sink is also disclosed in DE 362 1151 A1. Various inserts which may be inserted into the receiving area are provided separately from the basin. The inserts may be plates or further basin-like containers. These inserts may be positioned on the upper edge of the basin. The usability of a sink is also significantly restricted thereby and the inserts have to be attached or removed by a user, and it is always the case that the inserts are able to be positioned only at one individual position.

BRIEF SUMMARY OF THE INVENTION

It is the object of the present invention to provide a sink with a basin and a separate insert plate, in which a lifting device for the insert plate is able to be protected from media in the basin of the sink.

One aspect of the invention relates to a sink with a basin. The basin has a base wall and lateral walls adjoining the base wall. The basin also has a receiving area delimited by the base wall and the lateral walls. The receiving area is open at the top. The sink has an insert unit, in particular an insert plate, in particular a contiguous and non-perforated insert plate, which is separate from the basin. This insert plate is able to be inserted into the receiving area or is inserted therein. The sink also has a lifting device, by means of which the insert plate can be moved relative to the basin in the vertical direction of the sink. This is made possible by a physical lifting device of the sink. Thus a sink is provided in which in principle the possibility is provided to arrange the insert unit at different vertical positions. This is also made possible by a lifting device and does not have to be carried out manually by the user himself. In principle, it is possible that a continuous vertical adjustment of the insert plate is made possible by the lifting device. Thus it is possible to approach and set many different height levels of the insert plate.

The lifting device has at least one lifting unit. Moreover, the sink has an elastic sealing sleeve which is separate from the lifting unit and surrounds the lifting unit. The sealing sleeve is deformable in all spatial directions. It is configured as a sheath having a flexible shape. By means of a sealing sleeve, a specific sub-element of the lifting device, namely the actual lifting unit, is protected by this sealing sleeve. Since this sealing sleeve extends, in particular, at least in some regions into the receiving area of the basin, a seal is particularly advantageous in this regard. Due to this sealing sleeve entirely surrounding the lifting unit over the periphery at least in the receiving area of the basin, it is possible to avoid the situation where media located in the basin pass directly into the lifting unit. As a result, the lifting unit is permanently protected from such negative effects. Thus the functionality thereof may be permanently maintained.

In an advantageous embodiment it is provided that the sealing sleeve of the lifting device at least entirely surrounds the lifting unit over the periphery, at least over the partial region which extends into the receiving area. This is provided, in particular, in all of the different positions of the lifting unit when viewed in the vertical direction. Thus even with a corresponding change in the height of the lifting unit, and thus in the retracted or extended state, full protection may always be ensured by the sealing sleeve in an unrestricted manner.

In particular, it is provided that the sealing sleeve is configured to be longitudinally adjustable, when viewed in the vertical direction of the sink. This is a very advantageous embodiment. As a result, an adaptation to the length may be carried out corresponding to the change in the length of the lifting unit when the lifting unit is moved upwardly or moved downwardly.

In an exemplary embodiment it is provided that the sealing sleeve is of hollow-cylindrical configuration. In particular, the sealing sleeve is configured without edges and corners in the peripheral direction, when viewed around the vertical direction and thus around the longitudinal axis of the lifting unit. As a result, wear and tear may be kept low. Thus with continuous folding and unfolding of the sealing sleeve, it is possible to avoid undesired kinks which could otherwise arise in this regard in the peripheral direction around this longitudinal axis, which is oriented in the vertical direction. When viewed in the vertical direction the sealing sleeve has folds. In particular, it is provided that this hollow-cylindrical shape is also advantageous when the lifting unit also has a corresponding geometry. In particular, this may relate to a housing of the lifting unit. This housing may be configured from a plurality of dimensionally rigid hollow cylinders which are guided into one another in the vertical direction and which may be moved relative to one another in this vertical direction. Thus the housing is preferably configured as a telescopic housing consisting of a plurality of hollow cylinders. The lifting apparatus of the lifting unit may be arranged in this specific housing of the lifting unit. The housing segments of the housing of the lifting unit, which are mentioned by way of example, may be respectively dimensionally stable or dimensionally rigid in each case.

The lifting apparatus may be, for example, a feed chain or a spindle drive.

In particular, if this housing of the lifting unit is of cylindrical configuration, this lifting unit is also preferably advantageously surrounded by a corresponding geometric embodiment of the sealing sleeve. In particular, a space-saving embodiment is made possible thereby.

Preferably, it is provided that the sealing sleeve is configured at least in some regions as a folding bellows. This is an advantageous embodiment since in this regard at least a corresponding vertical elasticity is present, which permits a particularly advantageous compression and pulling apart in the vertical direction of the sink. On the other hand, a particularly advantageous and predetermined folding behavior is also formed by the embodiment of a folding bellows. As a result, it is possible to move together and pull apart the sealing sleeve in a very uniform manner. Preferably, it is provided that the sealing sleeve is arranged spaced apart from an outer face of the lifting unit, when viewed in the direction perpendicular to the vertical direction of the sink. In particular, in this context the sealing sleeve is arranged spaced apart from an outer face of the housing of the lifting unit. With such a free space or volume space between this lifting unit and the sealing sleeve, these two components may be moved independently of one another. Thus these two components do not bear directly against one another and thus are not able to impede one another in an undesired manner when the height is changed. In particular, rubbing against one another or jamming against one another is avoided thereby.

Preferably, it is provided that the sealing sleeve is clamped with a lower edge between the base wall of the basin and an adapter of the sink. The adapter is, in particular, a separate component from the sealing sleeve and a separate component from the base wall. A mechanically particularly stable and positionally fixed arrangement of the upper edge of the sealing sleeve may be achieved by such an adapter. An undesired release of the sealing sleeve in this upper region may be avoided by the clamping, when the sealing sleeve is pulled apart when the lifting unit is moved upwardly and is compressed when the lifting unit is moved downwardly. The adapter is, in particular, an adapter ring. It may be provided that the adapter ring is connected to the base wall by a non-destructive and releasable connection. For example, screw connections may be provided here. As a result, the lower edge of the sealing sleeve may also be clamped in a very appropriate manner.

In an advantageous embodiment it is provided that a seal is also formed at the same time by the lower edge of the sealing sleeve. Thus a feedthrough in the base wall of the basin, through which the lifting unit extends, is sealed by this seal. As a result, at least one partial region of the sealing sleeve is used in a multi-functional manner. Thus not only is the actual seal formed relative to the receiving area in the peripheral surroundings of the lifting unit, but a seal is also created by this feedthrough in the base wall. In particular, it may be achieved thereby that the lower edge is tightly pressed directly against the inner face of the base wall. This is achieved, in particular, by a corresponding mechanical connection between the adapter and the base wall. It may also be provided that this lower edge of the sealing sleeve has a thickened portion. An integrated sealing ring may be configured, as it were, in the sealing sleeve by such a thickened portion. For example, a corresponding channel or groove may thus be configured in the base wall and/or the adapter, this thickened portion, which may also be denoted as a bead, being able to be incorporated therein and a corresponding sealing behavior for the feedthrough is thus achieved in this regard.

In an advantageous embodiment it is provided that the sealing sleeve is clamped with an upper edge between a plate receiver and an upper face of an upper lifting segment of the lifting unit. In particular, the plate receiver is a separate component. In particular, this component is positioned from above onto the upper lifting segment. The plate receiver is preferably provided to receive support vanes. The insert plate is directly positioned on these support vanes. A mechanically stable fastening may also be achieved by this arrangement of the upper edge of the sealing sleeve. A positionally fixed seat of the sealing sleeve is achieved thereby. This is also advantageous regarding the dynamic movement of the sealing sleeve when folded up and pulled apart. It may also be provided that this upper edge is also clamped here so as to form a seal between the plate receiver and the upper face of the upper lifting segment.

In an advantageous embodiment it is provided that, in the pulled-apart state in the vertical direction, the sealing sleeve is tapered, when viewed from top to bottom.

In particular, it is provided that in the fully pulled-apart state the sealing sleeve is smooth on the outer face. In particular, when the sealing sleeve has folds in some regions in this vertical direction, these folds are pulled apart in this maximum possible lifting position or extended position of the lifting unit. Thus a particularly advantageous cleaning of the outer face of the sealing sleeve may be permitted in the removed state of the insert plate and in the fully upwardly moved state of the lifting unit.

In addition to its relevant protective function, the sealing sleeve is also configured as a protection against inadvertent contact. Contact with the lifting unit by the user is also avoided thereby.

In particular, as an alternative to a one-piece folding bellows, the sealing sleeve may also be configured from a plurality of sleeve segments. For example, a telescopic sleeve may be configured in this case. Thus a plurality of sealing sleeve segments are guided in one another and may be moved relative to one another in the vertical direction. Other types of extension elements which are elastic in the vertical direction may also be provided.

Preferably, it is provided that the sealing sleeve is configured in one piece. For example, the sealing sleeve may be configured from an elastomer.

Preferably, it is provided that at least the lifting unit has at least one ventilation opening. Air which is in a volume space between the sealing sleeve and the lifting unit may be conducted through the ventilation opening into the interior of the lifting unit. In particular, this may take place when the insert plate is moved downwardly in the receiving area and the volume space between the sealing sleeve and the lifting unit is thereby reduced. Specifically in such movement scenarios, it is necessary to remove the air from this volume space so as not to hinder a downward movement of the insert plate. This is also against the background of not generating a large undesired air pressure build-up in this volume space and thereby impeding the downward movement of the insert plate.

By removing the air into the interior of the lifting unit, it is possible to discharge the air out of the volume space in a very advantageous manner. On the one hand, therefore, the air may be conducted thereby below the basin of the sink. This is because the lifting unit advantageously extends through a feedthrough in the base wall. In particular, therefore, this air may be conducted out of this specific volume space downwardly out of the sink. In this case the discharge is not disruptive, so that an undesired airflow would not flow toward a user looking into the basin from above. Moreover, by discharging the air in such a manner it is advantageously also achieved that the sealing sleeve itself requires no such ventilation opening. Thus it is also possible to avoid the situation where media in the receiving area of the basin could pass into this volume space through such an opening in the sealing sleeve. In particular, therefore, the sealing sleeve may be configured entirely without holes.

A plurality of ventilation openings may also be provided. In particular, it is provided that the at least one ventilation opening is able to be closed by a closure element. Thus the design may be even further improved, since even if media were to be able to penetrate undesirably into the volume space, for example, the media would not pass via the ventilation opening into the interior of the lifting unit. Preferably, the volume space is configured between the sealing sleeve and a housing of the lifting unit. In this regard, a lifting apparatus of the lifting unit is in turn arranged in the interior of the housing of the lifting unit. Thus preferably this lifting apparatus is protected by a double sleeve, as it were. On the one hand, this is the housing of the lifting unit which is provided with sealing elements and, on the other hand, this is the sealing sleeve which is separate therefrom and which additionally surrounds this housing of the lifting unit over the periphery.

In particular, the ventilation opening is configured in the housing of the lifting unit. The air is thus discharged through the interior of the housing of the lifting unit in which the lifting apparatus is arranged. This closure element for closing the ventilation opening may be, for example, a flap or a slide. It is also possible that the ventilation opening is closed by a diaphragm. This diaphragm may be permeable to gaseous media and impermeable to liquid and solid media.

In one advantageous embodiment it is provided that the sink has at least one detector. A medium in the volume space between the sealing sleeve and the lifting unit may be detected by this detector. In particular, liquid media such as water may be detected by this detector. Leakages in the sealing sleeve may also be rapidly identified by means of such a detection and corresponding measures may be taken immediately.

In particular, it is provided that the closure element for closing the at least one ventilation opening is closed when the insert plate has reached the fully lowered state or the fully downwardly moved position. If the insert plate is moved upwardly again by the lifting unit, the closure element and also the ventilation opening are opened. As a result, air may pass through the interior of the lifting unit into the volume space between the sealing sleeve and the lifting unit. As a result, it is possible to avoid the situation where an undesired negative pressure is produced in this volume space which would hinder the upwardly moving lifting unit.

In particular, a plate receiver for the insert plate is configured on the upper region of the upper lifting segment. For example, this plate receiver may be implemented as an injection-molded component, in particular as a 2K injection-molded component. It may be provided that at least one through-hole is located in this plate receiver. An actuating element may extend through this through-hole from below. A support vane positioned on the plate receiver may be lifted thereby. In particular, a pivoting about a horizontal pivot axis may be carried out by this lifting so that a support vane may be positioned obliquely and thus in a tilted manner. Preferably, such a hole or a feedthrough in the plate receiver is covered in the upper region by an elastic component. As a result, it is possible to avoid the situation where media could pass from above into this hole in the plate receiver. Since this cover is configured in an elastic manner, the actuating element may act on this elastic element and bulge it upwardly. Thus a corresponding actuating force may also be transmitted to the support vane and this may be tilted.

In an advantageous embodiment it is provided that an upper face of the insert plate has a surface which is at least 80 percent, in particular at least 90 percent, in particular at least 95 percent, of the surface of the receiving area in a horizontal plane. The surface of the upper face of the insert plate, however, is less than 99 percent of this surface of the receiving area. By such a dimensioning, the insert plate is configured over virtually the entire surface area relative to the clear width of the receiving area between the lateral walls, and thus fills up this receiving area virtually entirely when viewed in the horizontal plane. On the other hand, however, a small gap, in particular of between 3 mm and 15 mm, in particular of between 3 mm and 10 mm, is permitted over the periphery so that, on the one hand, the relative movement of the insert plate may be carried out unhindered when setting the position or changing the position. In particular, as a result, this avoids direct contact and a side edge of the insert plate potentially scraping along the inner faces of the lateral walls. Thus, on the one hand, damage to the lateral walls is avoided and, on the other hand, damage to the insert plate and also to the lifting device is avoided. Last but not least, it is also advantageously achieved by this embodiment that liquid which is present on the upper face of the insert plate may be drained in a simple manner into the receiving area through this gap between the edge of the insert plate and the inner faces of the lateral walls.

Preferably, the basin has a drain, in particular on the base wall. As a result, a medium which is arranged in the basin and collects therein may drain out easily via the drain.

In particular, the basin is configured in one piece with the base wall and the lateral walls. In particular, the basin is configured from metal.

The base wall may be flat or slightly inclined or slightly bulged. In particular, it is provided that the point of the base wall at which an outlet for a drain of the sink is configured is offset furthest toward the bottom relative to the vertical position.

It may be provided that the upper face of the plate is configured to be entirely flat. However, the upper face may also be slightly bulged. It is also possible that the upper face of the insert plate is structured at least in some regions. As a result, a certain roughness may be generated. As a result, it is possible to avoid in an improved manner undesired slippage of objects positioned thereon. For example, this is advantageous when a change in the position of the insert plate occurs and objects are still arranged on the upper face of the insert plate. It is also possible that the upper face has specific positioning regions. These may be recesses. However, such recesses may be configured to be relatively small, for example. This is advantageous in order to be able to position, for example, vessels such as a glass or the like more securely. In particular, this is advantageous when a change in the position is tilting and/or rotating. An undesired slippage of such vessels is thus avoided. Moreover, it is also achieved by such predetermined positioning regions, for example, that when vessels are positioned on the upper face of the insert plate and, for example, are designed to be filled via the faucet, the water running out of the faucet flows accurately into the vessels with a rotational movement and does not run over the circumference of the vessels onto the insert plate.

The lifting device may have a lifting unit and a motor. The lifting unit may be moved by the motor at least in the vertical direction.

The positions and orientations provided when the sink is used as intended and arranged as intended are specified by the terms "top", "bottom", "front" "rear" "horizontal", "vertical", "depth direction", "width direction", "vertical direction".

Further features of the invention emerge from the claims, the figures and the description of the figures. The features and combinations of features mentioned above in the description, as well as the features and combinations of features mentioned below in the description of the figures and/or shown individually in the figures are not only able to be used in the respectively specified combination but also in other combinations or individually without departing from the scope of the invention. Thus embodiments of the invention which are not explicitly shown and described in the figures but which emerge from and which may be generated by separate combinations of features from the described embodiments are also to be regarded as encompassed and disclosed. Embodiments and combinations of features which thus do not have all of the features of an originally formulated independent claim are also to be regarded as disclosed.

BRIEF DESCRIPTION OF THE DRAWINGS

Exemplary embodiments of the invention are described hereinafter in more detail with reference to schematic drawings. In the drawings.

DETAILED DESCRIPTION OF EXEMPLARY EMBODIMENTS OF THE PRESENT INVENTION

Figure 1:
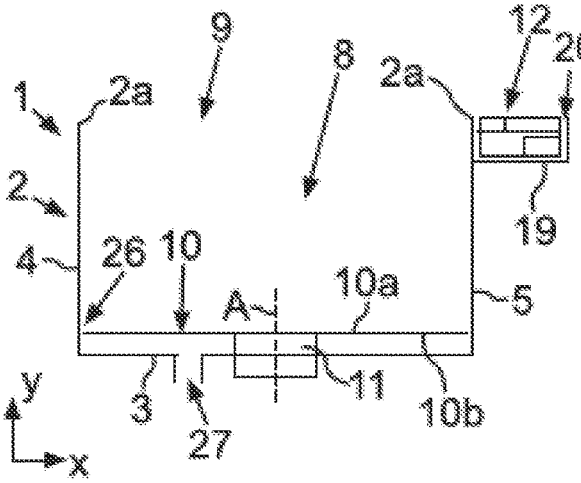
FIG. 1 shows a schematic sectional view through an exemplary embodiment of a sink according to the invention with an insert plate in a first position.

Elements which are the same or functionally the same are provided with the same reference characters in the figures.

Figure 3:
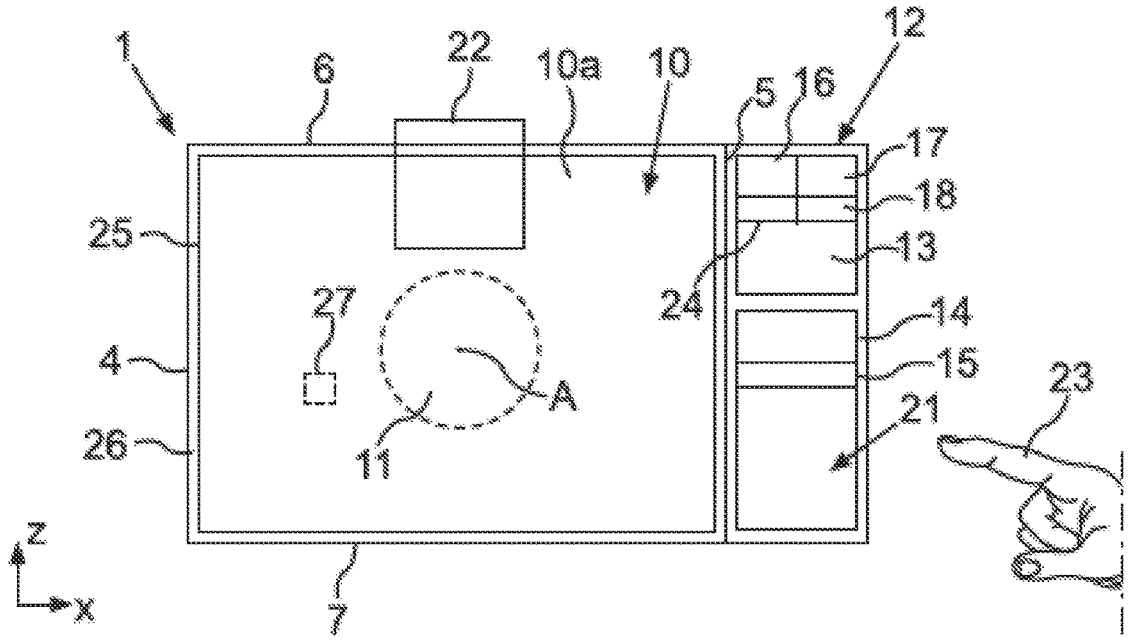
FIG. 3 shows a plan view of an exemplary embodiment of a sink.

A sink 1 is shown in FIG. 1 in a schematic vertical sectional view (x-y plane with the vertical direction y and width direction x). The sink 1 has a basin 2. The basin 2 has a base wall 3 and adjoining and upwardly extending lateral walls 4, 5, 6 (FIG. 3) and 7 (FIG. 3). The basin 2 is configured, in particular, in one piece. The basin is preferably configured from metal. The basin 2 has a receiving area 8. The receiving area 8 is delimited by the aforementioned walls 3 to 7. Thus the basin 2 has an upper loading opening 9. The sink 1 also has an insert unit. The insert unit is, in particular, an insert plate 10. The insert plate 10 is configured, in particular, in one piece. The insert plate may be configured from an upper plate and a lower plate connected such that it cannot be released in a non-destructive manner. The insert plate 10 is a component of the sink 1 which is separate from the basin 2. The sink 1 also has a lifting device 11. The insert plate 10 is arranged on the lifting device 11. In particular, the insert plate arranged on the lifting device 11 such that it can be released in a non-destructive manner. The insert plate 10 is movable relative to the basin 2 by the lifting device 11. In this context, a movement may take place in the vertical direction (y-direction) of the sink 1. Additionally or alternatively, a rotation may take place about a vertical axis A of the lifting device 11. Additionally or alternatively, a tilting of the insert plate 10 may take place. This means that the insert plate 10 may be set with its plane at an angle to a horizontal plane. It may thus be positioned in an inclined or oblique manner. In FIG. 1 the insert plate 10 is shown in an exemplary position in the receiving area 8. In particular, this is a position which has been moved downwardly. In this regard, the insert plate 10 is arranged directly adjacent to the base wall 3.

Preferably, the sink 1 has an interaction unit 12. The interaction unit 12 may have a display unit 13 (FIG. 3). The interaction unit 12 may have an operating device 14. The operating device 14 may have one or more operating elements. The operating elements may be push buttons or switches or toggle elements or rotary knobs. The operating device 14, however, may also additionally or alternatively have a touch-sensitive operating panel 15. In an advantageous embodiment it may be provided that the interaction unit 12 has at least one optical detection unit 16. The optical detection unit 16 may, for example, be a camera. The camera may be sensitive in the spectral range visible to humans. The interaction unit 12, however, may also additionally or alternatively have an acoustic unit 17. This acoustic unit 17 may be configured for the reception and/or for the output of speech signals. Moreover, the interaction unit 12 may have an identification unit 18. The identification unit 18 is configured for identifying, or for the identification of, a user of the sink 1. The identification unit 18 may also be formed, for example, by the optical detection unit 16. Additionally or alternatively, however, the identification unit 18 may also have, for example, the acoustic unit 17. As a result, for example, the user may be identified by the evaluation of a speech signal of a user. Additionally or alternatively, the identification unit 18 may be configured as a unit for detecting and evaluating a biometric feature of a user. For example, this may be a fingerprint sensor or a sensor for identifying an iris pattern.

Figure 2:
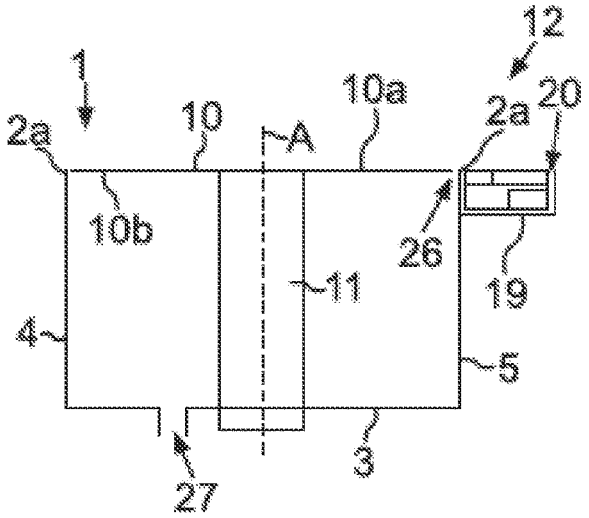
FIG. 2 shows the view of the sink according to FIG. 2 with the insert plate in a second position which is different from FIG. 1.

As may be identified in FIGS. 1 to 3, the interaction unit 12 may be configured at the side and directly adjacent to the basin 2. For example, a receiving housing 19 which is open at the top may be provided here. The receiving housing 19 may be configured separately from the basin 2. However, it may also be formed with the basin 2 such that it cannot be released in a non-destructive manner. In particular, the receiving housing 19 may also be configured in one piece with the basin 2. The lateral wall directly adjoining the receiving housing 19, in the example here the lateral wall 5, also forms a defining wall for the receiving volume 20 of the receiving housing 19.

Thus the receiving volume 20 is separated from the receiving area 8 of the basin.

In FIG. 2 the view according to FIG. 1 is shown, but the insert plate 10 is shown in a different position from FIG. 1. In FIG. 2 the insert plate 10 is oriented horizontally but moved upwardly. In particular, this position represents the maximum possible vertical position in normal mode. In particular, in this position an upper face 10*a* of the insert plate 10 is flush with an upper edge 2*a* of the basin 2. In particular, in this position the insert plate 10 forms a cover or a lid for the receiving area 8. This upper edge 2*a*, however, may also be for example an upper face of a mounting frame or a decorative frame which is a constituent part of the sink 1. The sink 1, in particular the basin 2, may be mounted with the mounting frame in a cutout of a worktop. The basin 2 may be covered from above with a decorative frame. A gap between the basin 2 and a defining wall in the worktop, which defines the cutout, thus may be covered from above. Such a decorative frame, in particular, represents an upper visible component of the arrangement.

In particular, the sink 1 also has a control unit 21 (FIG. 3). The lifting device 11 may be operated by the control unit 21. In particular, the interaction unit 12 may also be operated by the control unit 21.

The sink 1 may preferably also have a faucet 22, as may be identified in the simplified plan view in FIG. 3. The faucet 22 represents a functional unit of the sink 1. The interaction unit 12, in particular the operating device 14, may also be viewed as a functional unit of the sink 1. A further functional unit of the sink 1 may be the insert plate 10. A further functional unit of the sink 1 may be the lifting device 11.

The lifting device 11 preferably has a lifting unit and a motor. As a result, the lifting device may be changed in terms of its length or height in the direction of the vertical axis A. Moreover, the lifting device may be additionally or alternatively rotated about the vertical axis A. As a result, a rotational movement about this vertical axis A is also possible as a position, or as a change in the position, of the insert plate 10. Last but not least, the lifting device 11 may also be set such that the insert plate 10 may be set in an oblique or inclined manner relative to a horizontal plane.

An operating state of the sink 1 may be identified and/or a change in the operating state of the sink 1 may be identified and/or an operation of a user who operates the sink 1, in particular at least one functional unit of the sink 1, may be identified by the interaction unit 12. Depending on the identification by the interaction unit 12, the lifting device 11 is able to be operated for automatically changing the position of the insert plate 10. In FIG. 3 a schematic view of a finger 23 of a user is also shown. The interaction unit 12 is preferably configured for detecting a gesture of the user, in particular of the finger 23. In particular, the gesture is a contactless gesture. Additionally or alternatively, however, a direct operation of the operating device 14 may also be carried out with the finger 23. It is provided that an operating state and/or a change in the operating state may be detected by the camera 16 and/or the acoustic unit 17 and/or the operating device 14. An operating state may be, for example, a setting of the operating device 14 and/or a change in the operating state may be a change in the setting of the operating device 14.

A change in the position of the insert plate 10 may be dependent on the type and/or intensity and/or duration of an operating state of at least one functional unit of the sink 1 and/or a change in the position may be dependent on the type and/or intensity and/or duration of a change in the operating state of at least one such functional unit of the sink 1.

The interaction unit 12 has a normal mode. The actual operation of the sink 1 is also detected in this normal mode. Moreover, the interaction unit 12 has a defining mode which is different from the normal mode. This defining mode may be set, for example, by a user. In this defining mode it is possible that at least one user defines or predetermines at least one reference position of the insert plate 10. In particular, in this defining mode such a reference position may be linked with a specific operating state of at least one functional unit of the sink 1 and/or with a defined change in the operating state of at least one functional unit of the sink 1. At least one such reference position may be stored as a user profile in a memory unit 24 of the interaction unit 12.

In an advantageous embodiment it is provided that the surface shown in FIG. 3 (depth direction z and width direction x) of the upper face 10*a* is at least 80 percent, in particular at least 90 percent, in particular at least 95 percent, of the surface of the receiving area 8 which is viewed in a horizontal plane (in FIG. 3 the plane of the figures). In particular, however, this surface of the upper face 10*a* is less than 99 percent of this surface of the receiving area 8 in the aforementioned horizontal plane. As a result, it is achieved that a peripheral edge 25 of the insert plate 10 is spaced apart from the lateral walls 4, 5, 6 and 7. In particular, a peripheral gap 26 between the insert plate 10 and the lateral walls 4 to 7 is formed thereby. The gap 26 may be between 3 mm and 15 mm. Preferably, this gap 26 is sufficiently small, at least in the horizontal position of the insert plate 10, that objects such as cutlery or the like are not able to slip through. Moreover, it is thus possible to avoid the situation where a finger 23 is trapped in this horizontal position of the insert plate 10.

As is also shown in FIGS. 1 to 3, the sink 1 has an outlet opening 27, for example a drain. This outlet opening is configured, in particular, in the base wall 3. Media may drain out of the receiving area 8 from the basin 2 through this outlet opening 27.

Figure 4:
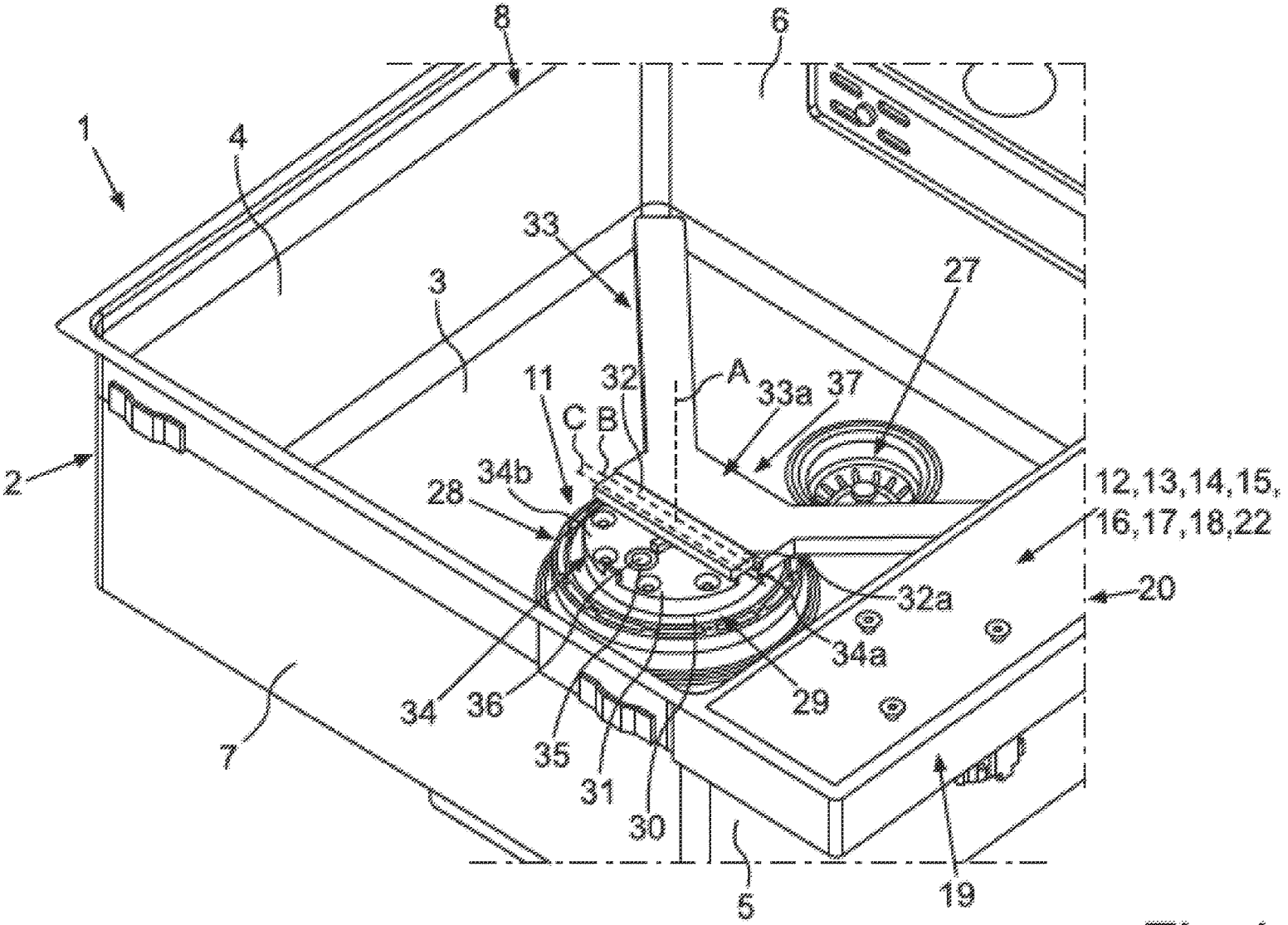
FIG. 4 shows a perspective partial view of an exemplary embodiment of a sink with an exemplary embodiment of support vanes of a lifting device.

An exemplary embodiment of a sink 1 is shown in FIG. 4 in a perspective view. The lifting device 11 is shown. The lifting device 11 has a lifting unit 28. This lifting unit is fastened, in particular, centrally in the middle of the base wall 3. The lifting unit 28 may be moved in the direction of the axis A. In this context, the lifting unit 28 has a plurality of lifting segments. The lifting unit 28 is shown in the fully moved-together state or in a defined lowered position of the normal mode in FIG. 4. This means that it is retracted to a maximum extent downwardly into the receiving area 8. Preferably, this lifting unit 28 has an upper lifting segment which is formed by an upper housing segment 29 of a housing 40 of the lifting unit 28. A plate receiver 31 is arranged in an upper region 30 of this upper lifting segment. The plate receiver 31 in this case is a flat cylindrical disk. This plate receiver 31 has a central projection 32. A first support vane 33 is arranged on this central projection 32. In particular, the support vane 33 is mounted on the central projection 32 so as to be pivotable about a horizontal axis B. The preferably one-piece support vane 33 is positioned from above on the plate receiver 31. An upper face 34 of this plate receiver 31 has upper face regions 34*a* and 34*b*. These upper face regions are offset downwardly relative to the central projection 32. The support vane 33 is positioned on this upper face region 34*a*. For the sake of improved clarity, however, a second support vane, not shown, which is separate from the first support vane 33 but in particular has the same size and the same shape is arranged thereon. This second support vane is mounted on the central projection 32 so as to be pivotable about a further horizontal axis C. The horizontal axes B and C are oriented parallel to one another. The second support vane is positioned from above on the second upper face region 34*b*. In the horizontal basic position, an upper face 33*a* of the support vane 33 is flush with an upper face 32*a* of the central projection 32. Accordingly, this is configured with an upper face of the second support vane.

The support vane 33 and the second support vane, not shown, are arranged spaced apart from one another by the central projection 32. They may be pivoted independently of one another about their axes B and C. Thus individual tilted positions of a support vane 33 may also be set relative to the horizontal plane. In particular, the plate receiver 31 also has a through-passage 35. An actuating element of the sink 1 may extend from below through the plate receiver 31 through this through-passage 35, and thus in this case come into contact with the second support vane from below and lift it up, so that it is pivoted about its horizontal axis C. Accordingly, a further through-passage which is below the first support vane 33 is configured on the side opposing the through-passage 35. This may also be accordingly lifted, as has been described above. Preferably, it is provided that the through-passage 35 is covered from above by an elastic cover 36. The elastic cover 36 permits the actuating element to be able to protrude through the through-passage 35 and to be positioned further up relative to the upper face region 34*b*, and a corresponding protruding of the actuating element may result due to the elastic deformation of the elastic cover 36. As a result, therefore, the corresponding second support vane may also be lifted. The plate receiver 31 is configured with the cover 36 as a 2K injection-molded part.

Figure 5:
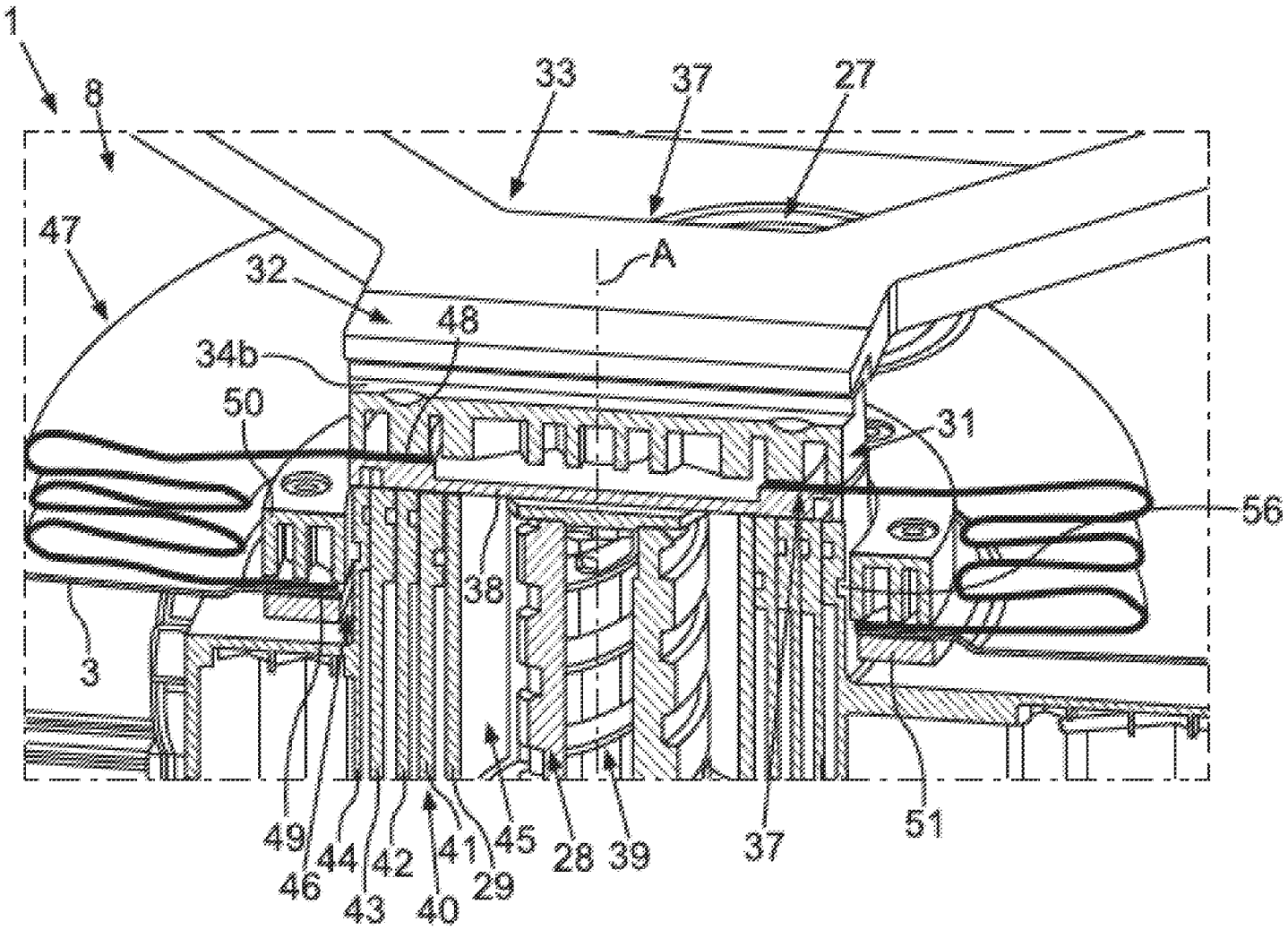
FIG. 5 shows a perspective sectional view of a partial region of the arrangement in FIG. 4 with a sealing sleeve around a lifting unit of the lifting device.

A partial region of the arrangement in FIG. 4 is shown in FIG. 5 in a perspective sectional view.

It may be identified that the plate receiver 31, which is configured as a flat cylinder, is positioned from above on an upper face 37 of the upper lifting segment of the lifting unit 28. This upper face 37 is, in particular, an upper face of an upper cover plate 38.

The lifting unit 28 has a lifting apparatus 39. The lifting apparatus 39 may be a spindle drive. However, it may also be a feed chain, for example. The lifting unit 28 also has a housing 40. The housing 40 surrounds this lifting apparatus 39 over the periphery. The housing 40 is, in particular, a telescopic housing. This means that it has a plurality of housing segments. In the exemplary embodiment, these lifting segments are configured as hollow cylinders. In the exemplary embodiment an upper housing segment 29 is configured in an extended state, a second housing segment 41 following downwardly, a further housing segment 42 following downwardly, a further housing segment 43 following downwardly and then a lower housing segment 44. The fully retracted position of the lifting unit 28 is shown in FIG. 5. The lifting unit 28 is thus moved entirely downward. In this state the housing 40 is fully telescoped and in a vertically minimized position. The housing segments 29 and 41 to 44 are thus fully telescoped as shown in FIG. 5. If the lifting unit 28 is extended out of this downwardly moved state in which the insert plate 10 is also arranged in the lowered position, and thus moved upwardly, the housing segments 29 and 41 to 44 are pulled apart. This is shown by way of example in the sectional view of a further exemplary embodiment of the sink 1 in FIG. 6. The lifting apparatus 39 is arranged in an interior 45 of this housing 40. The lifting unit 28 extends through a through-passage or feedthrough 46 in the base wall 3. The lifting unit 28 is thus arranged on either side of this base wall 3.

Moreover, the lifting device 11 has a sealing sleeve 47. The sealing sleeve 47 is a separate component from the housing 40. The sealing sleeve 47 surrounds that partial region which extends over the periphery in the receiving area 8 of the lifting unit 28. The sealing sleeve 47 is elastically configured. The sealing sleeve may be configured in one piece. The sealing sleeve may be configured, for example, as a folding bellows. However, other specifications are also possible in terms of material and geometry.

In FIG. 5 the sealing sleeve 47 is configured as a folding bellows. In FIG. 5 the sealing sleeve is shown in the fully compressed or folded-up state. The sealing sleeve 47 has an upper edge 48. In the exemplary embodiment shown, the upper edge 48 is clamped between the plate receiver 31 and the cover 38. In particular, this upper edge 48 is also arranged so as to form a seal between the plate receiver 31 and the cover 38. The cover 38 may also be denoted as a lifting plate.

Moreover, this sealing sleeve 47 has a lower end 49. This lower end 49 is positioned directly on the inner face of the base wall 3. Moreover, it is provided that the sink 1 has an adapter 50. This adapter 50 is preferably a separate component. The adapter 50 is preferably designed as a circumferential adapter ring which is configured without interruption. The adapter 50 is positioned from above on this lower edge 49 of the sealing sleeve 47. As may be identified, the lower edge 49 is clamped between this adapter 50 and the base wall 3. In particular, a sealed clamping is also configured here.

In particular, the adapter 50 is fastened to the base wall 3 such that it can be released in a non-destructive manner, in particular screwed by screw connections. To this end, for example, a counter bearing 51 may be arranged below the base wall 3. This counter bearing 51 may be a bearing ring. At the same time, the counter bearing may be configured as an acoustic damping unit.

A seal 56 may be arranged between the adapter 51 and an outer face of the housing segment 44.

Figure 6:
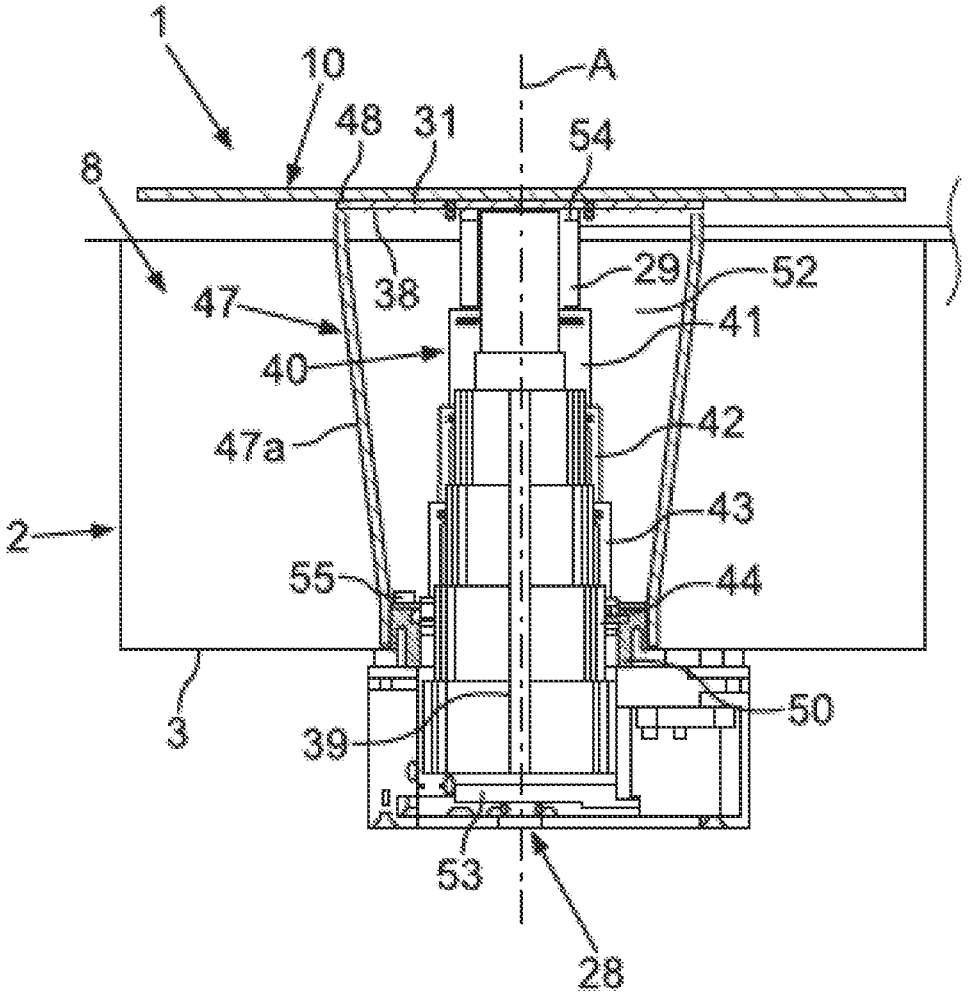
FIG. 6 shows a schematic sectional view of the sink with a lifting unit extended to a maximum and a sealing sleeve pulled out to a maximum.

In FIG. 6 the sink 1 is shown in a vertical sectional view. In the case of this sink 1, the lifting unit 28 is shown in the fully extended position in normal mode of the sink 1. In this position, in an advantageous embodiment the sealing sleeve 47 is also fully pulled apart, when viewed in the vertical direction. In particular, it is provided that in this state an outer face 47*a* of the sealing sleeve 47 is fully pulled apart and in this regard is smooth. Thus folds are no longer present.

As may also be identified in FIG. 6, a volume space 52 is configured between the lifting unit 28, in particular the housing 40, and the sealing sleeve 47. This means that in the radial direction the sealing sleeve 47 is arranged spaced apart from the lifting unit 28, in particular the housing 40. As may also be identified in FIG. 6, in this pulled-out state of the sealing sleeve 47, this sealing sleeve is configured to be tapered when viewed from top to bottom.

The lifting unit 28 also has at least one motor 53. This motor 53 drives the lifting apparatus 39.

In the pulled-out state of the sealing sleeve 47, this sealing sleeve is designed, in particular, as a hollow cylinder or in the manner of a hollow cylinder. In particular, the cover 38 is a component of the upper housing segment 29.

In an advantageous embodiment it is provided that the lifting unit 28 has at least one ventilation opening 54. The ventilation opening 54, as shown symbolically and by way of example in FIG. 6, is there so that air which is contained in the volume space 52 may be discharged out of the volume space 52 into the interior 45 when the insert plate 10 is moved downwardly, the sealing sleeve 47 is folded up and the volume space 52 is reduced. Similarly, air may be introduced via the interior 45 into the volume space 52 when the insert plate 10 is moved out of the lowered position, shown by way of example in FIG. 5, upwardly into the maximum vertical position shown in FIG. 6. A plurality of ventilation openings 54 may also be provided. In particular, it is possible that this at least one ventilation opening 54 is able to be closed by a closure element, not shown.

It may also be provided that the sink 1 has at least one detector 55, water in the volume space 52 being able to be detected thereby. The embodiment in FIG. 6 is different from FIG. 5 with regard to the design of the adapter ring 50. It may also be provided in FIG. 6 that an upper edge 48 is fastened differently from that shown in FIG. 5. This is only shown symbolically in FIG. 6, however. This is not to be understood to mean that the upper edge 48 would be fastened directly to the insert plate 10. A detector 55 is shown symbolically and by way of example with regard to the position.

A dismantling mode which is different from the normal mode of the lifting unit 28 may also be set. In this dismantling mode, the lifting unit 28 is set in a position located even higher in the vertical direction above the maximum lifted position of the lifting unit 28 in normal mode and thus also the corresponding position of the insert plate 10. In the maximum lifted position in normal mode it is provided, in particular, that the upper face 10*a* of the insert plate 10 is flush with the upper face of the upper edge 2*a* of the basin 2 or a decorative frame or a mounting frame. In the dismantling position which is higher for this purpose, the insert plate 10 is preferably positioned such that it is arranged with its lower face 10*b* higher than this upper edge 2*a* with a vertical spacing. In particular, this vertical spacing is at least 2 cm, in particular at least 3 cm. As a result, the insert plate 10 may be gripped on its edge 25 by a hand and securely held for removing from the lifting unit 28. The dismantling position is, in particular, a horizontal position of the insert plate 10. The lower face 10*b* of the insert plate 10 is thus positioned entirely above the upper edge 2*a*.

The invention claimed is:

1. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin and including a lifting unit;

an elastic sealing sleeve separate from the lifting unit and surrounding the lifting unit, and a plate receiver, wherein said sealing sleeve includes an upper edge which is clamped between the plate receiver and an upper face of an upper lifting segment of the lifting unit.

2. The sink of claim 1, wherein the sealing sleeve is configured to be longitudinally adjustable in a vertical direction of the sink.

3. The sink of claim 1, wherein the sealing sleeve is configured as a hollow cylinder.

4. The sink of claim 1, wherein the sealing sleeve has at least one region which is configured as a folding bellows.

5. The sink of claim 1, wherein the sealing sleeve is arranged spaced apart from an outer face of the lifting unit, when viewed in a direction perpendicular to a vertical direction of the sink.

6. The sink of claim 1, wherein the lifting unit includes a housing, said sealing sleeve being arranged spaced apart from an outer face of the housing, when viewed in a direction perpendicular to a vertical direction of the sink.

7. The sink of claim 1, further comprising an adapter, said sealing sleeve including a lower edge which is clamped between the base wall of the basin and the adapter.

8. The sink of claim 1, wherein the base wall includes a feedthrough for passage of the lifting unit, said sealing sleeve having a lower edge configured to form a seal for sealing the feedthrough in the base wall.

9. The sink of claim 1, wherein the lifting unit includes a housing, said upper lifting segment being an upper housing segment of the housing of the lifting unit.

10. The sink of claim 1, wherein, in a pulled-apart state in a vertical direction of the sink, the sealing sleeve is tapered, when viewed from top to bottom.

11. The sink of claim 1, wherein the sealing sleeve is configured in one piece.

12. The sink of claim 1, wherein the lifting unit and the sealing sleeve define a volume space there between, said lifting unit including a ventilation opening for allowing air in the volume space to be conducted into an interior of the lifting unit, or from the interior into the volume space.

13. The sink of claim 12, wherein the lifting unit includes a housing, said volume space being defined between the sealing sleeve and the housing of the lifting unit.

14. The sink of claim 12, further comprising a closure element to close the ventilation opening.

15. The sink of claim 1, further comprising a detector configured to detect water in a volume space between the sealing sleeve and the lifting unit.

16. The sink of claim 1, wherein the insert plate includes an upper face having a surface which is at least 80% of a surface of the receiving area in a horizontal plane but less than 99% of the surface of the receiving area.

17. The sink of claim 1, wherein the insert plate includes an upper face having a surface which is at least 90% of a surface of the receiving area in a horizontal plane but less than 99% of the surface of the receiving area.

18. The sink of claim 1, wherein the insert plate includes an upper face having a surface which is at least 95% of a surface of the receiving area in a horizontal plane but less than 99% of the surface of the receiving area.

19. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin and including a lifting unit; and an elastic sealing sleeve separate from the lifting unit and surrounding the lifting unit, wherein the lifting unit and the sealing sleeve define a volume space there between, said lifting unit including a ventilation opening for allowing air in the volume space to be conducted into an interior of the lifting unit, or from the interior into the volume space.

20. The sink of claim 19, further comprising a plate receiver, said sealing sleeve including an upper edge which is clamped between the plate receiver and an upper face of an upper lifting segment of the lifting unit.

* * * * *